United States Patent [19]

Hein et al.

[11] 4,211,326

[45] Jul. 8, 1980

[54] BLISTER PACKAGE

[75] Inventors: Carl C. Hein; Harold K. Silver; Joseph J. Spitz, all of Neenah; Donald W. Seidler, Appleton, all of Wis.

[73] Assignee: American Can Company, Greenwich, Conn.

[21] Appl. No.: 950,077

[22] Filed: Oct. 10, 1978

[51] Int. Cl.[2] ..... B65D 83/04

[52] U.S. Cl. ..... 206/484; 206/461; 206/539; 229/3.5 R; 229/43; 428/215; 428/457; 428/515; 428/516; 428/518

[58] Field of Search ..... 428/215, 216, 424, 480, 428/483, 494, 461, 516, 518, 520, 910, 457; 206/539, 484, 461; 229/3.5 R, 43

[56] References Cited

U.S. PATENT DOCUMENTS

| | | | |
|---|---|---|---|
| 3,097,787 | 7/1963 | Schur | 428/518 X |
| 3,386,645 | 6/1968 | Powell | 428/35 X |
| 3,504,075 | 3/1970 | Williams, Jr. et al. | 264/175 |
| 3,630,346 | 12/1971 | Burnside | 206/539 X |
| 4,158,411 | 6/1979 | Hall et al. | 206/539 |

OTHER PUBLICATIONS

Def. Pub. T861,016, 4/8/69.

*Primary Examiner*—James J. Bell
*Attorney, Agent, or Firm*—Robert P. Auber; Ira S. Dorman; Harry W. Hargis, III

[57] ABSTRACT

A blister package of the push-through type comprises a thermoformed blister portion made of a laminate sealed to a foil sheet. One of the laminae, prior to thermoforming, has been fluid compression rolled from a sheet to about one third of its original thickness affording a degree of orientation enhancing its moisture barrier properties, clarity, and strength in the thermoformed state.

14 Claims, 1 Drawing Figure

BLISTER PACKAGE

BACKGROUND OF THE INVENTION

This invention relates to package structure, and more particularly to improvements in laminate structures enhancing its use as a thermoformed element of blister package structure.

Drugs in tablet or capsule form have been packaged in thermoformed blister packaging of the so-called press-through-package type fabricated from moisture barrier materials. In addition to moisture protection, it is further desirable that a material exhibit clarity, stiffness, and good thermoforming properties. Laminate structure comprising laminae of polyvinyl chloride (PVC) and chloro-trifluoroethylene, sold under the trademark Aclar, has been found suitable for packaging of the aforementioned type but is inherently costly. Plain PVC as well as PVC/polyvinylidene chloride (PVDC) combinations have also been used in an effort to reduce cost, but have not provided as good a barrier as the above identified Aclar combination.

It is a general objective of this invention to provide an improved packaging material of the hereinabove described type that is both economical and approaches the protective properties of the PVC/Aclar laminate structure.

SUMMARY OF THE INVENTION

In achievement of the foregoing as well as other general objectives and advantages, the invention contemplates, for use in a blister package, theremoformable laminate packaging structure comprising a first lamina of compression rolled, partially oriented polymer, and at least a second lamina of polymer on one face of the first lamina.

The manner in which the foregoing as well as other general objectives and advantages of the invention may best be achieved will be more fully understood from the following description, taken in light of the accompanying drawing.

DESCRIPTION OF THE PREFERRED EMBODIMENT

Figure 1:
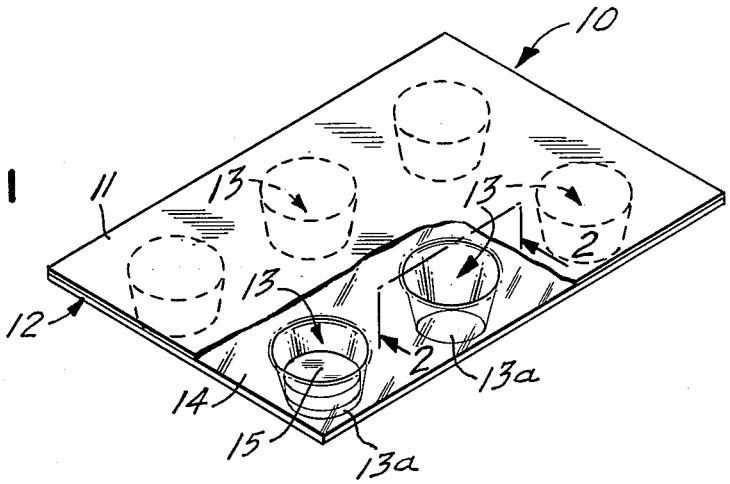
FIG. 1 is a perspective showing, with parts broken away, of a blister package embodying the invention.

With more detailed reference to the drawing, there is seen in FIG. 1 a blister package 10 including a pair of confronting sheets 11 and 12, the latter provided with a plurality of thermoformed pockets 13 surrounded by heat sealed regions 14. Pockets 13 confront sheet 11 to define individual compartments for each of a plurality of tablets, one of which is shown at 15.

Sheet 11 comprises a metal foil, such as, for example, aluminum foil, provided with a suitable sealable lamina (not shown) that holds it in moisture vapor proof engagement with flat surface of sheet 12. Access to tablets 15 is had by applying finger pressure to the relatively thin, less rigid bottom wall 13*a* (FIG. 2) to urge the contained tablet against the overlying foil 11 with sufficient force to tear the foil.

Figure 2:
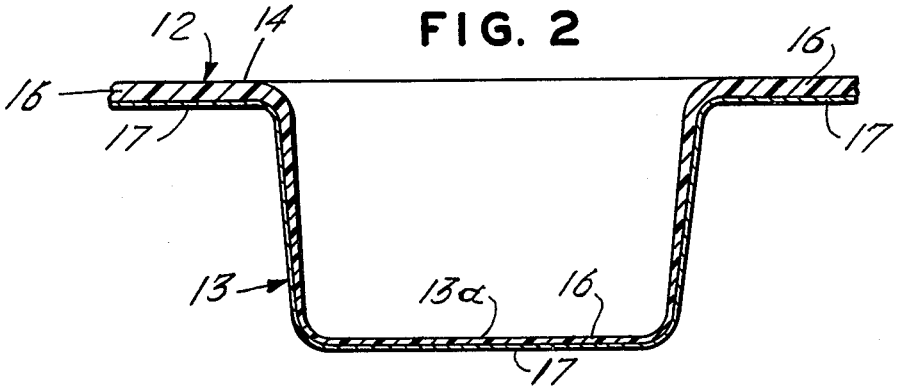
FIG. 2 is a sectional showing taken in the plane of lines 2—2 in FIG. 1, as seen looking in the direction of arrows applied thereto.

In particular accordance with the invention, and with reference to FIG. 2, the material of sheet 12 comprises a laminate structure in which, prior to thermoforming, the lamina 16 comprises PVC about 2 mils to 8 mils thick, with a preferred thickness of about 6 mils, and lamina 17 comprises a sheet of polymeric material, such as high density polyethylene (HDPE), that has been fluid compression rolled, in accordance with teachings of U.S. Pat. No. 3,504,075, to about 2 to 6 mils, with a preferred thickness of about 3 mils, which is about $\frac{1}{3}$ of its original thickness. Rolling the polymeric material to $\frac{1}{3}$ its original thickness provides thermoformability in the resulting laminate structure as compared to full fluid compression rolling which produces a non-thermoformable material. The laminate structure is achieved by performing an adhesive lamination operation using a 2-part alcohol base, curing type polyurethane adhesive (not shown).

The hereinabove described laminate structure affords a degree of adhesion between the PVC and the compression rolled HDPE lamina that prevents delamination and uneven draw in formation of pockets 13, thus also ensuring a high degree of optical clarity. This latter quality is attributable to the fluid compression rolling, as compared to the poor optical clarity of non-fluid compression rolled HDPE.

Typically, pocket 13 draw depths are limited to about $\frac{1}{2}$ inch for a $\frac{7}{8}$ inch diameter circle, with area ratios ranging up to about 1:3. Area ratio is the ratio of the initial area from which the pocket or blister 13 is drawn to the final area of the surface of the pocket. It will be appreciated that a draw of such proportions will result in a thinning of the laminate structure, with the thinnest layer being the more remote surface comprising the bottom wall 13*a* of a pocket 13.

While adhesive lamination is preferred, the laminate structure 12 can be formed using extrusion lamination procedures. Since clarity and rigidity are desired of the thermoformed portions in a majority of blister package structures, resort is had to adhesive lamination procedures.

Moisture barrier properties of the laminate structure 12 comprising the hereinabove described laminae of PVC and HDPE have approached levels only previously obtainable using fluorocarbon type laminae such as, for example, the hereinabove identified material known as Aclar. Moisture vapor transmission rate (MVTR) of flat samples tested under test specification ASTM-E96 have exhibited values as low as 0.052 grams $H_2O$/100 in$^2$/24 hrs., as compared with values of 0.02–0.03 grams $H_2O$/100 in$^2$/24 hrs. for Aclar laminate structures and 0.20–0.45 grams $H_2O$/100 in$^2$/24 hrs. for PVC structures. Advantageously, the thinning of the laminate structure that occurs upon thermoforming pockets 13 has been found not appreciably to detract from its MVTR property per unit thickness, and its relationship to the MVTR of the Aclar structure.

Figure 3:
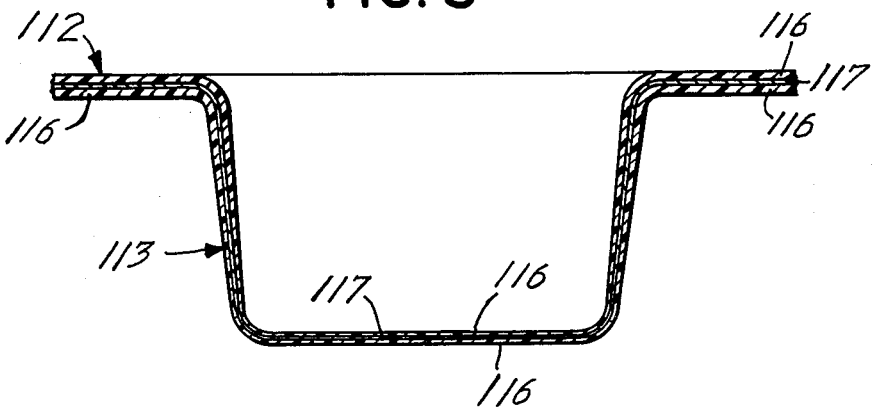
FIG. 3 is a sectional showing of a modified embodiment taken in a plane similar to FIG. 2.

Optionally, in a modified package 112 as shown in FIG. 3, a second lamina 116 of PVC may be adhered to the second face of the fluid compression rolled lamina 117 of HDPE. In this event, the sum of the thicknesses of the two laminae 116 before thermoforming pockets 113 is from about 4 mils to about 16 mils thickness, with a preferred thickness of about 8 mils. The thickness of the fluid compression rolled lamina 117 is the same as described for FIG. 2.

Sealable lamina 16 or 116 alternatively may comprise polyethylene terephthalate (PET), copolyesters, polypropylene, acrylonitrile copolymers, or XT polymer. XT polymer is sold by Cy/Ro Industries, Wayne, N.J., and is a polymethylmethacrylate modified with butadiene rubber.

Alternatively, fluid compression rolled lamina 17 or 117 may comprise polypropylene, low density polyethylene (LDPE), medium density polyethylene (MDPE), or ethylene propylene copolymers.

It will be appreciated that the disclosed laminate structure affords packaging of many types of drugs, in tablet and capsule form, at high protection levels and at substantially reduced cost. Other sensitive materials could likewise be packaged.

While a preferred embodiment of the invention has been described and illustrated, it will be appreciated that the disclosed pockets may be disposed in other arrays. These and other modifications are contemplated by the scope of the appended claims.

We claim:

1. Thermoformable laminate package structure adapted for blister packaging comprising: a first, outer lamina of polyvinyl chloride, an intermediate lamina of fluid compression rolled, partially oriented polymeric material, and a second, outer lamina of polyvinyl chloride.

2. Structure according to claim 1 wherein said first and second, outer laminae are each about 4 mils thick and said lamina of polymeric material is from about 2 mils to about 6 mils thick, the recited thickness of said polymeric material being about ⅓ of its thickness prior to the recited fluid compression rolling.

3. Structure according to claims 1 or 2, wherein said polymeric material is selected from the group consisting of high density polyethylene, medium density polyethylene, low density polyethylene, polypropylene, and ethylene propylene copolymers.

4. Blister package structure comprising a pair of confronting moisture vapor barrier sheets sealed to one another, at least one of said sheets including a thermoformed pocket surrounded by a region of the recited sealing, said one sheet comprising first and second laminae of polyvinyl chloride, and an intermediate lamina of fluid compression rolled, partially oriented polymeric material.

5. Structure according to claim 4 wherein said first and second, outer laminae are each about 4 mils thick and said lamina of polymeric material is from about 2 mils to about 6 mils thick, the recited thickness of said polymeric material being about ⅓ of its thickness prior to the recited fluid compression rolling.

6. Structure according to claims 4 or 5, wherein said polymeric material is selected from the group consisting of high density polyethylene, medium density polyethylene, low density polyethylene, polypropylene, and ethylene propylene copolymers.

7. Structure according to claim 4, and wherein the other of said pair of confronting sheets comprises metal foil.

8. A laminate sheet adapted for blister packaging comprising first and second laminae of polyvinyl chloride and an intermediate lamina of fluid compression rolled, partially oriented polymeric material, said sheet including at least one thermoformed pocket.

9. Laminate sheet according to claim 8 wherein each said first lamina and said second lamina is about 4 mils thick, and said intermediate lamina is from about 2 mils to about 6 mils thick, the recited thickness of said polymeric material from which said pocket is thermoformed being about ⅓ of its thickness prior to the recited compression rolling.

10. Laminate sheet according to claim 8 or 9 wherein said polymeric material is selected from the group consisting of high density polyethylene, medium density polyethylene, low density polyethylene, polypropylene, and ethylene propylene copolymers.

11. Thermoformable laminate packaging structure adapted for blister packaging, comprising: a first thermoformable lamina of polymeric material and a second lamina of fluid compression rolled, partially oriented polymeric material, characterized in that the material of said first lamina is selected from the group consisting of polyvinyl chloride, polyethylene terephthalate, copolyesters, polypropylene, acrylonitrile copolymer and rubber modified polymethylmethacrylate, and the material of said second lamina is selected from the group consisting of low density polyethylene, medium density polyethylene, high density polyethylene, polypropylene and ethylene propylene copolymers.

12. Structure according to claim 11 wherein said first lamina is about 8 mils thick and said second lamina is from about 2 mils to about 6 mils thick, the recited thickness of said second lamina being about ⅓ of its thickness prior to the recited fluid compression rolling.

13. Blister package structure comprising a pair of confronting moisture vapor barrier sheets sealed to one another, at least one of said sheets including a thermoformed pocket surrounded by a region of the recited sealing, said one sheet comprising a first lamina, the material of said first lamina being selected from the group of thermoformable materials consisting of polyvinyl chloride, polyethylene terephthalate, polypropylene, acrylonitrile copolymer and rubber modified polymethylmethacrylate, and a second fluid compression rolled, partially oriented, lamina, the material of said second lamina being selected from the group consisting of low density polyethylene, medium density polyethylene, high density polyethylene, polypropylene and ethylene propylene copolymers.

14. Structure according to claim 13 wherein said first lamina is about 8 mils thick and said second lamina is from about 2 mils to about 6 mils thick, the recited thickness of said second lamina being about ⅓ of its thickness prior to the recited fluid compression rolling.

* * * * *